US007284541B1

(12) United States Patent
Uchida

(10) Patent No.: US 7,284,541 B1
(45) Date of Patent: Oct. 23, 2007

(54) PURGE SYSTEM FOR INTERNAL COMBUSTION ENGINE

(75) Inventor: Akikazu Uchida, Kariya (JP)

(73) Assignee: DENSO CORPOARTION, Kariya, Aichi-pref. (JP)

( * ) Notice: Subject to any disclaimer, the term of this patent is extended or adjusted under 35 U.S.C. 154(b) by 0 days.

(21) Appl. No.: 11/723,381

(22) Filed: Mar. 19, 2007

(30) Foreign Application Priority Data

Mar. 29, 2006 (JP) ..... 2006-092364

(51) Int. Cl.
*F02M 33/02* (2006.01)
*F02M 33/04* (2006.01)

(52) U.S. Cl. ..... 123/520

(58) Field of Classification Search ..... 123/520, 123/519, 518, 516
See application file for complete search history.

(56) References Cited

U.S. PATENT DOCUMENTS 5,005,550 A * 4/1991 Bugin et al. ..... 123/520
5,183,023 A * 2/1993 Hanson ..... 123/520
5,979,418 A * 11/1999 Saruwatari et al. ..... 123/519
6,138,644 A 10/2000 Saruwatari et al.

FOREIGN PATENT DOCUMENTS

JP 11-287162 10/1999

* cited by examiner

*Primary Examiner*—Mahmoud Gimie
(74) *Attorney, Agent, or Firm*—Nixon & Vanderhye P.C.

(57) ABSTRACT

A canister is connected with a fuel tank to adsorb fuel vapor generated in the fuel tank. The canister is also connected to a downstream side point of an intake air pipe, which is on a downstream side of a supercharging device, through a first purge line. The canister is also connected to an upstream side point of the intake air pipe, which is on an upstream side of the supercharging device, through a second purge line. An ECU opens a first valve of the first purge line and a second valve of the second purge line to generate an air flow through the first connection passage, the canister and the second connection passage to desorb the fuel vapor from the adsorbent and to purge the desorbed fuel vapor into the intake air passage in an operational period of the supercharging device.

9 Claims, 3 Drawing Sheets

PURGE SYSTEM FOR INTERNAL COMBUSTION ENGINE

CROSS REFERENCE TO RELATED APPLICATION

This application is based on and incorporates herein by reference Japanese Patent Application No. 2006-92364 filed on Mar. 29, 2006.

BACKGROUND OF THE INVENTION

1. Field of the Invention

The present invention relates to a purge system for an internal combustion engine.

2. Description of Related Art

A purge system is a system that limits dispersion of fuel vapor into a surrounding environment upon generation, i.e., evaporation of the fuel vapor in a fuel tank. Specifically, the fuel vapor is supplied from the fuel tank into a canister, which contains an adsorbent to temporarily adsorb the fuel vapor. The fuel vapor, which is adsorbed by the adsorbent, is desorbed from the adsorbent with aid of a negative pressure that is generated in an intake air pipe during an operation of the engine. Thus, the desorbed fuel vapor is mixed with intake air to form a mixture gas, which is in turn purged into the intake air pipe through a purge passage.

Each of Japanese Unexamined Patent Publication No. H11-173220 (U.S. Pat. No. 6,138,644) and Japanese Unexamined Patent Publication No. H11-287162 recites a purge system of the internal combustion engine, which has a supercharging device in the intake air passage. In the purge system recited in Japanese Unexamined Patent Publication No. H11-173220, the purge of the fuel vapor is made possible even when the pressure in the intake air passage becomes a negative pressure due to a supercharging operation of the supercharging device. This is made possible by communicating the purge passage to an upstream side point of the intake air passage, which is on a upstream side of the supercharging device, and also placing a purge control valve and an electric pump in the purge passage. During the purge operation of the purge system, a constant drive electric current is supplied to the electric pump, and an opening degree of the purge control valve is controlled according to a required purge air quantity.

In the purge system recited in Japanese Unexamined Patent Publication No. H11-287162, a first purge valve is provided in a first purge passage, which communicates between the canister and a downstream side point of the intake air passage, which is located on a downstream side of the throttle valve. Also, a second purge valve is provided in a second purge passage, which communicates between the canister and the upstream side point of the intake air passage, which is located on the upstream side of the supercharging device. During the supercharging operation of the supercharging device, the second purge valve is opened to purge the fuel vapor from the second purge passage. During an absence of the supercharging operation of the supercharging device, the first purge valve is opened to purge the fuel vapor from the first purge passage.

However, in the case of the purge system recited in Japanese Unexamined Patent Publication No. H11-173220, when the electric pump is provided in the purge passage to purge the fuel vapor by the air flow created by the electric pump, an increase in the electric power consumption of the purge system, an increase in an installation space of the purge system and an increase in the costs disadvantageously occur.

In contrast, in the case of the purge system recited in Japanese Unexamined Patent Publication No. H11-287162, the negative pressure, which is created by the operation of the throttle valve or the supercharging device, is used to purge the fuel vapor without use of the electric pump. Thus, the above disadvantages will not occur in this purge system. However, the negative pressure, which is developed on the upstream side of the supercharging device through the operation of the supercharging device is generally small. Thus, it is often difficult to implement a sufficient purge quantity during the supercharging operation of the supercharging device.

SUMMARY OF THE INVENTION

The present invention addresses the above disadvantages. According to one aspect of the present invention, there is provided a purge system for an internal combustion engine. The purge system includes a fuel tank, a fuel vapor passage, a canister, an intake air passage, a supercharging device, a first connection passage, a first valve, a second connection passage, a second valve and a control means. The fuel tank receives fuel. The fuel vapor passage is communicated with the fuel tank to conduct fuel vapor, which is generated in the fuel tank. The canister is communicated with the fuel tank through the fuel vapor passage and includes an adsorbent, which is received in an interior of a housing of the canister to adsorb the fuel vapor. The intake air passage conducts intake air to the engine. The supercharging device is provided in the intake air passage to supercharge the intake air. The first connection passage communicates between the interior of the housing of the canister and a first connection point of the intake air passage, which is located on a downstream side of the supercharging device in a flow direction of the intake air in the intake air passage. The first valve is provided in the first connection passage to open and close the first connection passage. The second connection passage communicates between the interior of the housing of the canister and a second connection point of the intake air passage, which is located on an upstream side of the supercharging device in the flow direction of the intake air in the intake air passage. The second valve is provided in the second connection passage to open and close the second connection passage. The control means is for controlling the first valve and the second valve. The control means opens the first valve and the second valve to generate an air flow, which flows from the first connection point of the intake air passage to the second connection point of the intake air passage through the first connection passage, the interior of the housing of the canister and the second connection passage to desorb the fuel vapor from the adsorbent and to purge the desorbed fuel vapor into the intake air passage in an operational period of the supercharging device, during which the supercharging device supercharges the intake air.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
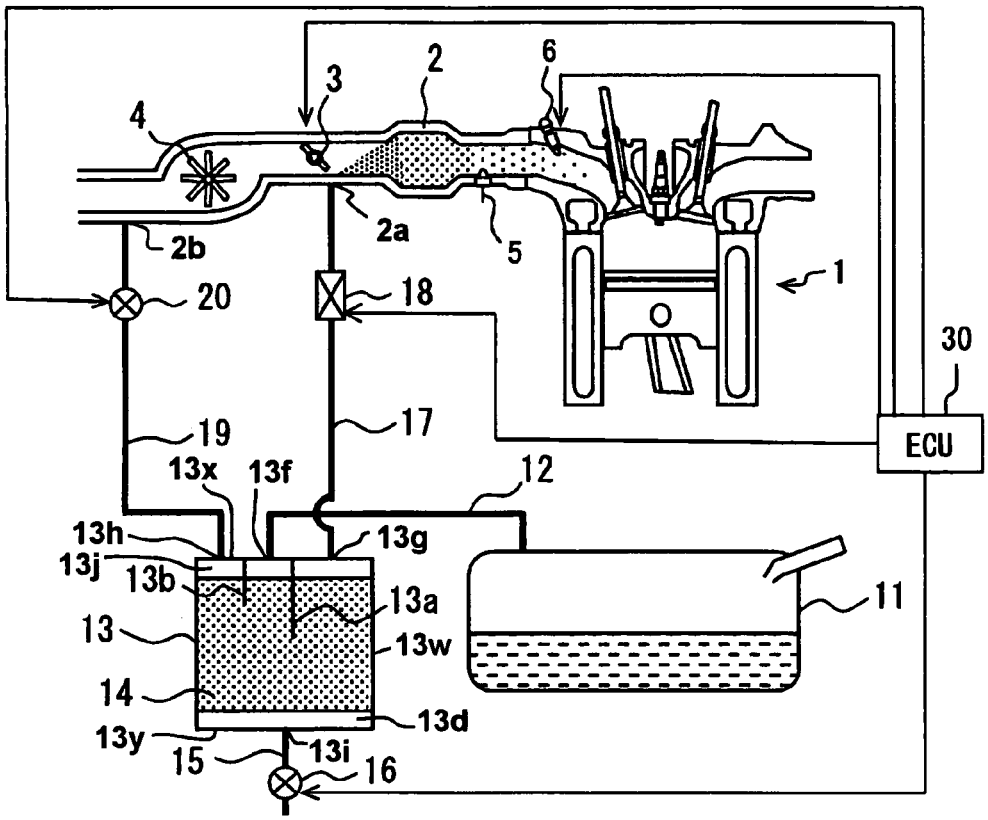
FIG. 1 is a diagram showing a structure of a purge system according to a first embodiment of the present invention.
Figure 2:
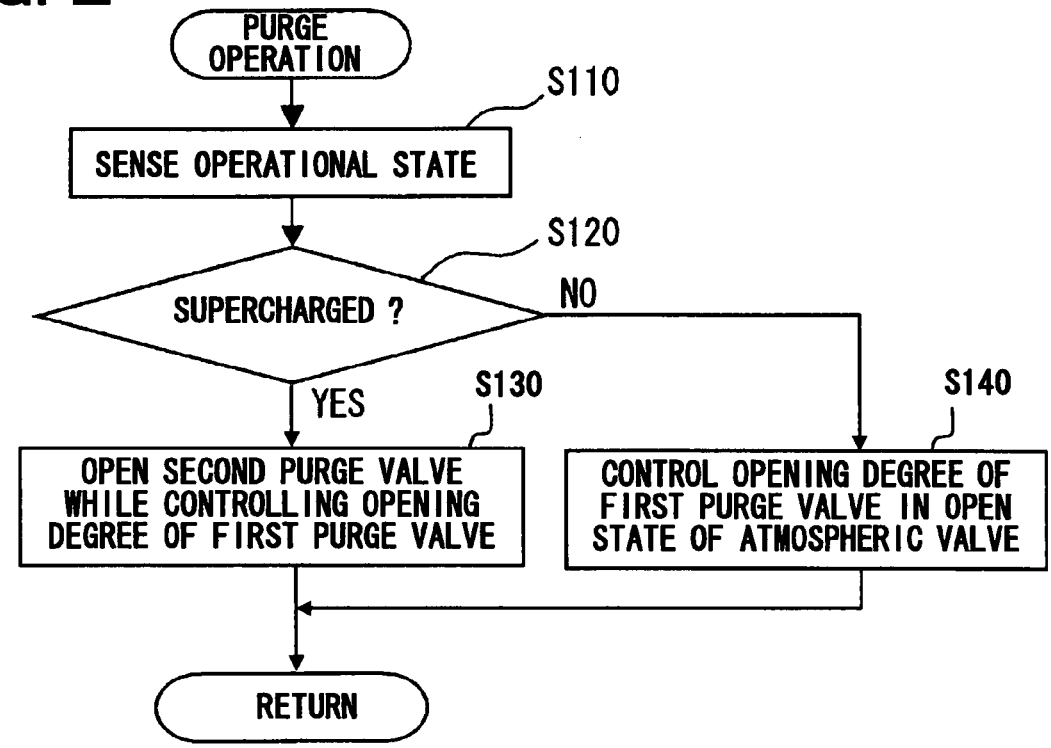
FIG. 2 is a flowchart showing a purge operation according to the first embodiment.

A first embodiment of the present invention will be described with reference to FIGS. 1 and 2. FIG. 1 is a diagram showing a structure of a purge system according to the first embodiment. The purge system of the present embodiment is applied to, for example, an internal combustion engine of a vehicle, which has a supercharging device. The supercharging device may be a turbocharger, which uses exhaust pressure to rotate a compressor to supercharge the intake air. Alternatively, the supercharging device may be a supercharger, which uses an engine power to rotate a compressor to supercharge the intake air. Further alternatively, the supercharging device may be a supercharging device, which uses an electric motor to rotate a compressor to supercharge the intake air.

A fuel tank 11 of the engine 1 is connected to a canister 13 through an evaporation line 12, which is a fuel vapor passage. An adsorbent 14 is received in an interior of a housing 13*w* of the canister 13. When fuel vapor, which has been evaporated in the fuel tank 11, is supplied to the canister 13 through the evaporation line 12, the fuel vapor is temporarily adsorbed by the adsorbent 14.

The canister 13 is connected to an intake air pipe 2 of the engine 1 through a first purge line (a first connection passage) 17 at a downstream side point (a first connection point) 2*a*, which is located on a downstream side of the supercharging device 4 in a flow direction of the intake air in the intake air pipe 2. A first purge valve 18 is provided in the first purge line 17. The first purge valve 18 is a solenoid valve, an opening degree of which is linearly adjustable from an electronic control unit (ECU) 30.

The canister 13 is also connected to the intake air pipe 2 through a second purge line 19 at an upstream side point (a second connection point) 2*b* of the intake air pipe 2, which is located on an upstream side of the supercharging device 4 in the flow direction of the intake air in the intake air pipe 2. A second valve 20 is provided in the second purge line 19. The second purge valve 20 is an on/off valve, which is controlled by the ECU 30 to switch between a valve-open position and a valve-closed position. The second purge valve 20 is closed when a drive signal is not received from the ECU 30.

A fuel vapor port 13*f*, a first purge line port 13*g* and a second purge line port 13*h* (not shown) are formed through a top wall (a first wall) 13*x* of the housing 13*w* of the canister 13, which forms a first end portion of the housing 13*w*. The fuel vapor port 13*f*, the first purge line port 13*g* and the second purge line port 13*h* are communicated with the interior of the canister 13 at one end thereof and are communicated with the evaporation line 12, the first purge line 17 and the second purge line 19, respectively, at the other end thereof to allow communication with the interior of the canister 13.

An atmospheric port 13*i* extend through a bottom wall (a second wall) 13*y* of the housing 13*w* of the canister 13, which is opposed to the top wall 13*x* of the canister 13 and forms a second end portion of the housing 13*w*. One end of an atmospheric line 15 is connected to the atmospheric port 13*i* of the canister 13, and the other end of the atmospheric line 15 is opened to the atmosphere. An atmospheric valve 16 is provided in the atmospheric line 15 and is controlled by the ECU 30 to switch between a valve-open position and a valve-closed position. When the atmospheric valve 16 is placed in the valve-open position, the atmospheric air is supplied into the canister 13. Here, the atmospheric valve 16 is placed into the valve-open position when a drive signal is not supplied from the ECU 30.

A first partition plate 13*a* extends from an interior surface of the top wall of the canister 13 into the adsorbent 14 at a location between the fuel vapor port 13*f*, which is connected to the evaporation line 12, and the first purge line port 13*g*, which is connected to the first purge line 17. A second partition plate 13*b* extends from the interior surface of the top wall 13*x* of the canister 13 into the adsorbent 14 at a location between the fuel vapor port 13*f*, which is connected to the evaporation line 12, and the second purge line port 13*h*, which is connected to the second purge line 19.

As shown in FIG. 1, in the interior of the canister 13, a space 13*j* is formed between the interior surface of the top wall 13*x* and a top of the adsorbent 14. The first partition plate 13*a* and the second partition plate 13*b* limit the fuel vapor, which is supplied from the evaporation line 12 into the interior of the canister 13 through the fuel vapor port 13*f*, to flow into the first purge line 17 and the second purge line 19 through the first purge line port 13*g* and the second purge line port 13*h*, respectively. A length of the first partition plate 13*a*, which is measured in a direction of extension of the first partition plate 13*a* into the adsorbent 14 (a top-to-bottom direction of the housing 13*w* of the canister 13 in FIG. 1), is longer than that of the second partition plate 13*b*, so that the first partition plate 13*a* extends more in the adsorbent 14 in comparison to the second partition plate 13*b*.

The ECU 30 controls an opening degree of a throttle valve 3, which is provided in the intake air pipe 2 to adjust an intake air quantity, and a fuel injection quantity of an injector 6, based on measurement values, which are sensed through various sensors. For example, these measurement values may include an intake air pressure, an intake air quantity, an air/fuel ratio, an ignition signal, an engine rotational speed, an engine coolant temperature and/or an accelerator opening degree (an amount of depression of an accelerator pedal). Among these measurement values, the intake air pressure is sensed with an intake air pressure sensor 5 provided on a downstream side of the throttle valve 3 in the intake air pipe 2, and the intake air quantity is sensed with an air flow sensor (not shown). Also, the air/fuel ratio is sensed with an air/fuel ratio sensor (not shown) provided in the exhaust pipe.

Furthermore, besides the above control operations, the ECU 30 executes a purge operation to process the fuel vapor, which is adsorbed by the adsorbent 14 in the canister 13. The purge operation will now be described in detail.

According to the present embodiment, the first purge line 17 and the second purge line 19 are provided to purge a mixture gas of the fuel vapor and the air (hereinafter, referred to as an evaporation gas) into the intake air pipe 2 without use of an additional device, such as an electric pump.

In an operational state of the supercharging device 4 for supercharging the intake air, the pressure in the intake air pipe 2 on the downstream side of the supercharging device 4 becomes a positive pressure, and the pressure in the intake air pipe 2 on the upstream side of the supercharging device 4 becomes a negative pressure. In the present embodiment, at the time of supercharging the intake air by the supercharging device 4, the first purge valve 18 and the second purge valve 20 are both opened, and the atmospheric valve 16 is closed to purge the evaporation gas through use of a pressure difference between the positive pressure and the negative pressure developed in the intake air pipe 2. In this way, an air flow is generated from the downstream side point 2*a* of the intake air pipe 2 to the upstream side point 2*b* of the intake air pipe 2 through the first purge line 17, the canister 13 and the second purge line 19. When this air flow passes through the canister 13, the fuel vapor, which has been adsorbed by the adsorbent 14, is desorbed from the adsorbent 14 to form the evaporation gas, which is then purged into the intake air pipe 2 on the upstream side of the supercharging device 4.

As described above, the purge operation of the present embodiment is carried out through use of the pressure difference between the negative pressure, which is developed on the upstream side of the supercharging device 4, and the positive pressure, which is developed on the downstream side of the supercharging device 4. Thus, a sufficient purge quantity can be implemented by the purge operation of the present embodiment in comparison to a case where only the negative pressure, which is developed on the upstream side of the supercharging device 4, is used to purge the evaporation gas.

Furthermore, in the present embodiment, the temperature of the air in the intake air pipe 2 on the downstream side of the supercharging device 4 is heated by a supercharging heat, which is generated through the supercharging of the intake air by the supercharging device 4 on the downstream side of the supercharging device 4. When this heated high temperature air is supplied into the interior of the canister 13, the fuel vapor is more effectively desorbed from the adsorbent 14. Because of this additional factor, the sufficient purge quantity can be more effectively implemented during the normal supercharging period.

In contrast, a negative pressure is developed in the intake air pipe 2 on the downstream side of the throttle valve 3 due to the operation of the throttle valve 3 during a non-supercharging period, in which the supercharging operation of the supercharging device 4 is not performed at all, or during a low level supercharging period, in which the supercharging operation of the supercharging device 4 is performed at a low level. At this time, the first purge valve 18 and the atmospheric valve 16 are both opened, and the second purge valve 20 is closed, so that the evaporation gas is purged through use of this negative pressure, which is developed due to the operation of the throttle valve 3. In this way, an air flow is generated in the intake air pipe 2 on the downstream side of the throttle valve 3 through the atmospheric line 15, the canister 13 and the first purge line 17. When this air flow passes through the canister 13, the fuel vapor, which has been adsorbed by the adsorbent 14, is desorbed to form the evaporation gas, which is then purged into the intake air pipe 2 on the downstream side of the throttle valve 3.

As described above, in the purge system of the present embodiment, the sufficient purge quantity can be implemented in all of the non-supercharging period, the low level supercharging period and the normal supercharging period of the supercharging device 4.

Now, the reason whey the length of the second partition plate 13*b* is made shorter in comparison to the first partition plate 13*a* will be described.

When the fuel vapor, which is evaporated in the fuel tank 11, is supplied into the interior of the canister 13 through the evaporation line 12, the fuel vapor is adsorbed by a close area of the adsorbent 14, which is close to the fuel vapor port 13*f*, to which the evaporation line 12 is connected. Then, when more fuel vapor is supplied into the interior of the canister 13, the adsorbed extent of the adsorbent 14, to which the fuel vapor is adsorbed, is extended further in a direction away from the fuel vapor port 13*f*. As a result, the close area of the adsorbent 14, which is close to the fuel vapor port 13*f*, has adsorbed more fuel vapor in comparison to a far area of the adsorbent 14, which is far from the fuel vapor port 13*f*.

When the length of the second partition plate 13*b* is made shorter than the length of the first partition plate 13*a*, the air flow, which flows from the first purge line port 13*g* to the second purge line port 13*h* in the canister 13 during the normal supercharging period, passes through the relatively close area of the adsorbent 14, which is relatively close to the fuel vapor port 13*f*. Therefore, the air flow desorbs the fuel vapor from the adsorbent 14 to produce the fuel rich evaporation gas. During the normal supercharging period of the supercharging device 4, a large quantity of fuel vapor can be purged. Thus, even when the fuel vapor is desorbed from the adsorbent 14, which has adsorbed the large quantity of fuel vapor, to generate the fuel rich evaporation gas, it is possible to perform the sufficient purge operation. Also, in this way, the sufficient purge quantity of fuel vapor can be easily implemented during the normal supercharging period.

Furthermore, according to the present embodiment, as shown in FIG. 1, the fuel vapor port 13*f*, to which the evaporation line 12 is connected, is placed between the first purge line port 13*g*, to which the first purge line 17 is connected, and the second purge line port 13*h*, to which the second purge line 19 is connected. Thus, a distance between the first purge line port 13*g* and the second purge line port 13*h* can be made relatively long. As a result, when the air flow is conducted from the first purge line port 13*g* to the second purge line port 13*h* in the canister 13 during the normal supercharging period of the supercharging device 4, the fuel vapor can be desorbed from the wide area of the adsorbent 14 in the canister 13. Thus, the fuel rich evaporation gas, which contains the relatively large quantity of fuel vapor, can be generated. Therefore, the greater quantity of fuel vapor can be purged during the normal supercharging period.

Furthermore, according to the present embodiment, the atmospheric port 13*i*, which is connected to the atmospheric line 15, is formed through the bottom wall 13*y* of the canister 13. Thus, the route of the air flow in the adsorbent 14 of the canister 13 differs between the time of flowing the air from the atmospheric port 13*i* to the first purge line port 13*g* in the canister 13 during the non-supercharging period or the low level supercharging period and the time of flowing the air from the first purge line port 13*g* to the second purge line port 13*h* during the normal supercharging period. In this way, the desorption of the fuel vapor from the adsorbent 14 is performed through the entire area of the adsorbent 14 rather than the partial area of the adsorbent 14. As a result, the adsorbing capacity of the adsorbent 14 is effectively restored.

At the time of the purge operation, the opening degree of the first purge valve 18 is controlled to achieve the target air/fuel ratio in view of a sum of the fuel quantity supplied in the form of the purged evaporation gas and the fuel quantity injected from the injector 6 based on the air/fuel ratio sensor provided in the exhaust pipe. Alternatively, a sensor, which senses a concentration of the evaporation gas, may be provided. In this instance, the fuel quantity, which is supplied in the form of evaporation gas, is computed in advance. Then, the opening degree of the first purge valve 18 may be controlled in such a manner that the sum of the fuel quantity, which is supplied in the form of evaporation gas, and the fuel quantity, which is injected from the injector 6, coincides with the target fuel quantity.

According to the present embodiment, only the first purge valve 18 is made in the form of the solenoid valve, the opening degree of which can be linearly adjusted, and the second purge valve 20 is made in the form of the on/off valve. However, as discussed above, during the non-supercharging period or the low level supercharging period, the evaporation gas is purged into the intake air pipe 2 through the first purge valve 18. In such a case, the fuel quantity, which is supplied to the engine 1, is relatively small, so that the purge quantity of the evaporation gas needs to be accurately controlled. This need is met by controlling the flow quantity of evaporation gas to a desired level through use of the first purge valve 18. Furthermore, during the normal supercharging period of the supercharging device 4, when the evaporation gas is purged through the second purge valve 20, the air, which is required to form this evaporation gas, first passes the first purge valve 18. Thus, the flow quantity of the evaporation gas can be controlled through use of the first purge valve 18. Because of this reason, the on/off valve, which is simple and low cost, can be used as the second purge valve 20.

Next, the control operation, which is executed by the ECU 30 to perform the purge operation, will be described with reference to a flowchart of FIG. 2. The purge operation of FIG. 2 is executed when a purge execution condition is satisfied. The satisfaction of the purge execution condition is determined based on the operational state (e.g., the engine coolant temperature, the hydraulic fluid temperature, the engine rotational speed). For instance, when the engine coolant temperature is raised equal to or greater a predetermined temperature after engine cranking, it is determined that an engine warm-up period is over. When it is determined that the engine warm-up period is over, it is then determined that the purge execution condition is satisfied. Furthermore, even during the engine operation, when a fuel cut operation is performed due to deceleration of the vehicle, the purge execution condition is not satisfied. Thus, the purge is stopped.

When the purge execution condition is satisfied, the supercharging operational state of the supercharging device 4 is sensed at step S110. The sensing of the supercharging operational state may be accomplished by sensing the pressure in the intake air pipe 2 on the downstream side of the supercharging device 4 with the intake air pressure sensor 5 or by sensing the opening degree of the throttle valve 3. Specifically, when the normal supercharging operation is performed by the supercharging device 4, the intake air pressure, which is sensed with the intake air pressure sensor 5, becomes the positive pressure that is equal to or greater than a predetermined pressure, or the opening degree of the throttle valve 3 is increased equal to or greater than a predetermined opening degree. Thus, the supercharging operational state of the supercharging device 4 can be determined based on the intake air pipe pressure and/or the throttle valve opening degree.

Then, at step S120, it is determined whether the sensed supercharging operational state of the supercharging device 4 is the normal supercharging state, the non-supercharging state or the low level supercharging state (i.e., the state where the level of supercharging is relatively low and can be substantially considered as the non-supercharging state). Here, the low level supercharging state is a state, at which the level of supercharging performed by the supercharging device 4 is low, so that the intake air pipe pressure on the downstream side of the throttle valve 3 becomes a negative pressure due to the operation of the throttle valve 3. When it is determined that the current operational sate is the normal supercharging state at step S120, the operation proceeds to step S130. In contrast, when it is determined that the current operational state is the non-supercharging state or the low level supercharging state, the operation proceeds to step S140.

At step S130, the second purge valve 20 is switched to the valve-open position while the opening degree of the first purge valve 18 is controlled. In this way, the route is established from the downstream side point 2*a* of the intake air pipe 2, which is on the downstream side of the supercharging device 4, to the upstream side point 2*b* of the intake air pipe 2, which is located on the upstream side of the supercharging device 4, through the canister 13. Therefore, the air flow is created due to the pressure difference between the positive pressure, which is developed on the downstream side of the supercharging device 4, and the negative pressure, which is developed on the upstream side of the supercharging device 4. As a result, the fuel rich evaporation gas is purged into the intake air pipe 2.

In contrast, at step S140, the opening degree of the first purge valve 18 is controlled in the open state of the atmospheric valve 16. At this time, the second purge valve 20 is kept closed. Thus, the air flow, which passes the atmospheric line 15, the canister 13 and the first purge line 17, is created due to the negative pressure, which is developed on the downstream side of the throttle valve 3. Therefore, the evaporation gas is purged.

Figure 3:
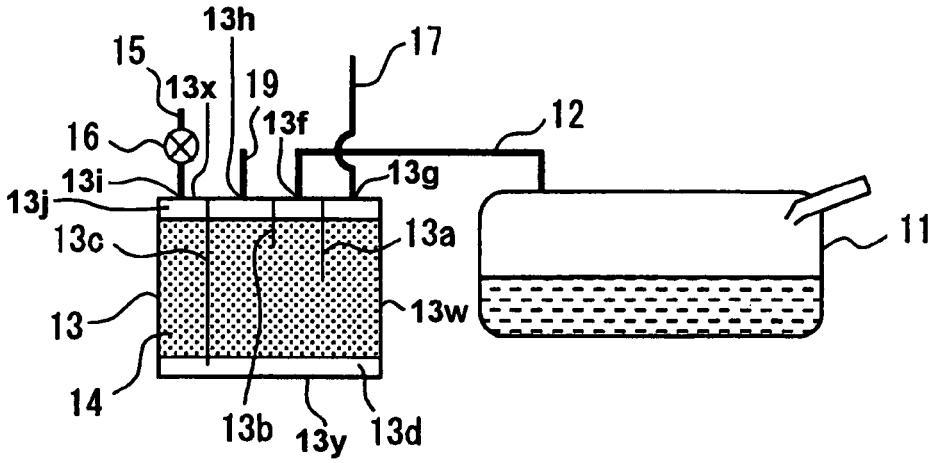
FIG. 3 is a diagram showing a modification of the purge system of the first embodiment.

In the purge system of the first embodiment, the atmospheric port 13*i*, which is connected to the atmospheric line 15, is formed through the bottom wall 13*y* of the canister 13. Alternatively, as shown in FIG. 3, in which the ECU 30 is not depicted for the sake of simplicity, the atmospheric port 13*i* may be formed through the top wall 13*x* of the canister 13. In such a case, a third partition plate 13*c*, which extends from the interior surface of the top wall 13*x* generally to the charge depth of the canister 13 (i.e., generally or almost to an interior surface of the bottom wall 13*y*), may be formed between the atmospheric port 13*i* and the other ports 13*f*, 13*g*, 13*h*. Thus, the adsorbent 14 is substantially, completely divided into two divided parts by the third partition plate 13*c*.

In this case, during the non-supercharging period or the low level supercharging period, the air flow, which flows from the atmospheric port 13*i* to the first purge port 13*g*, is conducted through the two divided parts of the adsorbent 14, which is divided by the third partition plate 13*c*, and is also conducted through the bottom interior space 13*d*, which is located between the adsorbent 14 and the interior surface of the bottom wall 13*y* of the canister 13. Thus, similar to the first embodiment, the route of the air flow in the adsorbent 14 of the canister 13 differs between the time of flowing the air from the atmospheric port 13*i* to the first purge line port 13*g* in the canister 13 during the non-supercharging period or the low level supercharging period and the time of flowing the air from the first purge line port 13*g* to the second purge line port 13*h* during the normal supercharging period.

In the case where the atmospheric port 13*i* is provided in the top wall 13*x* of the canister 13, it is desirable to place the second purge line port 13*h* and the fuel vapor port 13*f* between the atmospheric port 13*i* and the first purge line port 13*g*. In this way, when the air flows from the atmospheric port 13*i* to the first purge line port 13*g*, the fuel vapor can be desorbed from the wide area of the adsorbent 14 in the canister 13 to effectively recover the adsorbing capacity of the adsorbent 14.

Second Embodiment

Next, a second embodiment of the present invention will be described with reference to FIGS. 4 and 5, in which the ECU 30 is not depicted for the sake of simplicity. In the following description, components, which are similar to those of the first embodiment, will be indicated by the same numerals and will not be described further for the sake of simplicity.

The purge system of the second embodiment differs from the purge system of the first embodiment such that the atmospheric line and the atmospheric valve are eliminated from the purge system of the second embodiment. The purge system of the second embodiment will be described in detail with reference to FIG. 4.

Figure 4:
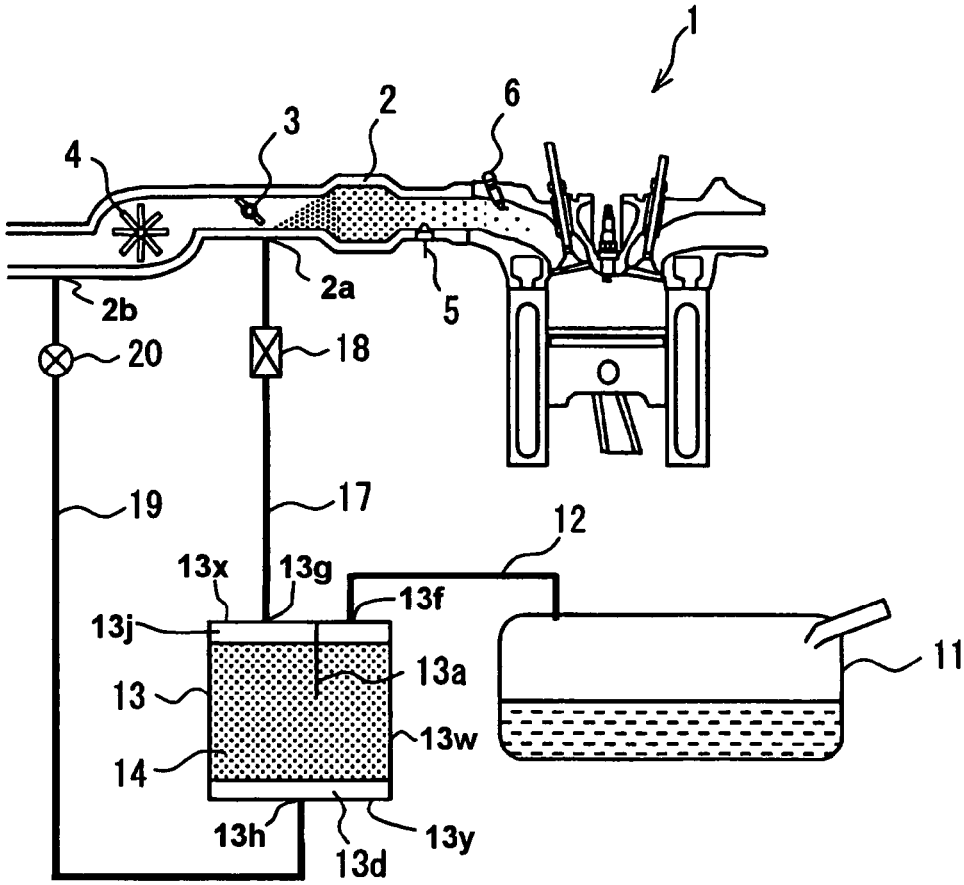
FIG. 4 is a diagram showing a structure of a purge system according to a second embodiment of the present invention.
Figure 5:
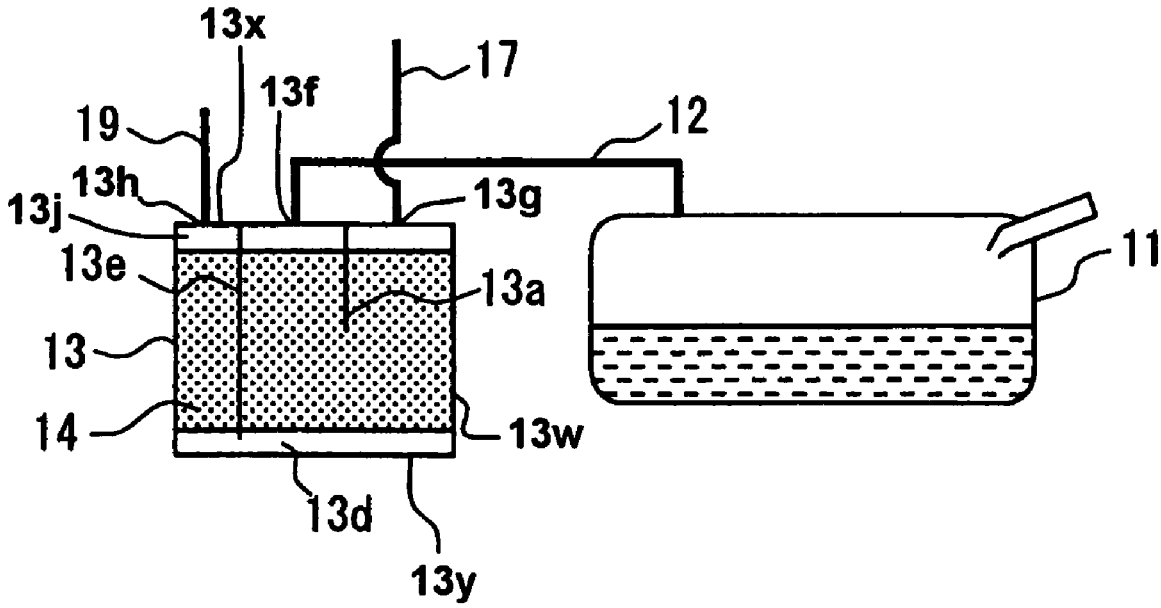
FIG. 5 is a diagram showing a modification of the purge system of the second embodiment.

As shown in FIG. 4, the fuel vapor port 13*f*, to which the evaporation line 12 is connected, and the first purge line port 13*g*, to which the first purge line 17 is connected, are formed through the top wall 13*x* of the canister 13. The first partition plate 13*a* extends from the interior surface of the top wall 13*x* of the canister 13 into the adsorbent 14 at the location between the fuel vapor port 13*f* and the first purge line port 13*g*. The second purge line port 13*h*, to which the second purge line 19 is connected, is formed through the bottom wall 13*y* of the canister 13.

As described above, the atmospheric line and the atmospheric valve are not provided to the canister 13 of the purge system of the second embodiment. A purge operation, which enables the purge of the evaporation gas during the normal supercharging period, the non-supercharging period and the low level supercharging period in the absence of the atmospheric line and the atmospheric valve, will now be described.

First, at the time of purging the evaporation gas in the normal supercharging period of the supercharging device 4, the first purge valve 18 and the second purge valve 20 are both opened, like in the first embodiment. In this way, an air flow is generated from the downstream side point 2*a* of the intake air pipe 2, which is located on the downstream side of the supercharging device 4, to the upstream side point 2*b* of the intake air pipe 2, which is located on the upstream side of the supercharging device 4, through the first purge line 17, the canister 13 and the second purge line 19. When this air flow passes through the canister 13, the fuel vapor, which has been adsorbed by the adsorbent 14, is desorbed from the adsorbent 14 to form the evaporation gas, which is then purged into the intake air pipe 2 on the upstream side of the supercharging device 4.

At the time of purging the evaporation gas during the non-supercharging period and the low level supercharging period of the supercharging device 4, the first purge valve 18 and the second purge valve 20 are both opened. At the time of purging the evaporation gas during the non-supercharging period and the low level supercharging period, the negative pressure, which is generated due to the operation of the throttle valve 3, is used. When the first purge valve 18 and the second purge valve 20 are both opened, the route is formed to communicate between the upstream side point 2*b* of the intake air pipe 2, which is located on the upstream side of the supercharging device 4, and the downstream side point 2*a* of the intake air pipe 2, which is located on the downstream side of the supercharging device 4 and is also on a downstream side of the throttle valve 3. Thus, the air flow is generated from the upstream side point 2*b* of the intake air pipe 2, which is located on the upstream side of the supercharging device 4, to the downstream side point 2*a* of the intake air pipe 2, which is located on the downstream side of the throttle valve 3. When this air flow passes through the canister 13, the fuel vapor, which has been adsorbed by the adsorbent 14, is desorbed to form the evaporation gas, which is then purged into the intake air pipe 2 on the downstream side of the throttle valve 3.

Therefore, even in the purge system of the second embodiment, the sufficient quantity of evaporation gas can be purged during the normal supercharging period, the non-supercharging period and the low level supercharging period of the supercharging device 4 while eliminating the atmospheric line and the atmospheric valve.

Furthermore, in the purge system of the present embodiment, the air flow passes through the adsorbent 14 in the canister 13 at the time of flowing the air from the first purge line port 13*g* to the second purge line port 13*h* in the canister 13 and also at the time of flowing the air from the second purge line port 13*h* to the first purge line port 13*g* in the canister 13. Thus, the fuel vapor can be desorbed from the wide area of the adsorbent 14 to effectively recover the adsorbing capacity of the adsorbent 14.

In the purge system of the second embodiment, the second purge line port 13*h*, which is connected to the second purge line 19, is formed through the bottom wall 13*y* of the canister 13. Alternatively, as shown in FIG. 5, the second purge line port 13*h* may be formed through the top wall 13*x* of the canister 13. In such a case, the ports 13*f*, 13*g*, 13*h* are arranged such that the fuel vapor port 13*f* is placed between the second purge line port 13*h* and the first purge line port 13*g*. Furthermore, a partition plate (a fourth partition plate) 13*e*, which extends from the interior surface of the top wall 13*x* generally to the charge depth of the canister 13 (i.e., generally to an interior surface of the bottom wall 13*y*), may be formed between the second purge line port 13*h* and the fuel vapor port 13*f*.

In this case, during the non-supercharging period or the low level supercharging period, the air flow, which flows from second purge line port 13*h* to the first purge line port 13*g*, is conducted through two divided parts of the adsorbent 14, which is divided by the partition plate 13*e*, and is also conducted through the bottom interior space 13*d*, which is located between the adsorbent 14 and the interior surface of the bottom wall 13*y* of the canister 13.

At this time, the fuel vapor port 13*f* is placed between the first purge line port 13*g* and the second purge line port 13*h* to have the relatively long distance between the first purge line port 13*g* and the second purge line port 13*h*. Thus, the fuel vapor can be desorbed from the wide area of the adsorbent 14, and thereby the adsorbing capacity of the adsorbent 14 can be effectively recovered.

Additional advantages and modifications will readily occur to those skilled in the art. The invention in its broader terms is therefore not limited to the specific details, representative apparatus, and illustrative examples shown and described.

What is claimed is:

1. A purge system for an internal combustion engine, comprising:

a fuel tank that receives fuel;

a fuel vapor passage that is communicated with the fuel tank to conduct fuel vapor, which is generated in the fuel tank;

a canister that is communicated with the fuel tank through the fuel vapor passage and includes an adsorbent, which is received in an interior of a housing of the canister to adsorb the fuel vapor;

an intake air passage that conducts intake air to the engine;

a supercharging device that is provided in the intake air passage to supercharge the intake air;

a first connection passage that communicates between the interior of the housing of the canister and a first connection point of the intake air passage, which is located on a downstream side of the supercharging device in a flow direction of the intake air in the intake air passage;

a first valve that is provided in the first connection passage to open and close the first connection passage;

a second connection passage that communicates between the interior of the housing of the canister and a second connection point of the intake air passage, which is located on an upstream side of the supercharging device in the flow direction of the intake air in the intake air passage;

a second valve that is provided in the second connection passage to open and close the second connection passage; and a control means for controlling the first valve and the second valve, wherein the control means opens the first valve and the second valve to generate an air flow, which flows from the first connection point of the intake air passage to the second connection point of the intake air passage through the first connection passage, the interior of the housing of the canister and the second connection passage to desorb the fuel vapor from the adsorbent and to purge the desorbed fuel vapor into the intake air passage in an operational period of the supercharging device, during which the supercharging device supercharges the intake air.

2. The purge system according to claim 1, wherein:

an opening degree of the first valve is linearly variable; and the second valve is operable only between a valve open position and a valve closed position.

3. The purge system according to claim 1, further comprising:

an atmospheric passage that communicates between the interior of the housing of the canister and a surrounding atmosphere;

a third valve that is provided in the atmospheric passage and is controlled by the control means to open and close the atmospheric passage; and a throttle valve that is provided in the intake air passage on a downstream side of the supercharging device in the flow direction of the intake air in the intake air passage to adjust a quantity of the intake air, which is supplied to the engine, wherein:

the first connection point of the intake air passage is located on a downstream side of the throttle valve in the flow direction of the intake air;

the control means opens the first valve and the third valve and closes the second valve to generate an air flow, which flows from the atmospheric passage to the first connection point of the intake air passage through the interior of the housing of the canister and the first connection passage to desorb the fuel vapor from the adsorbent and to purge the desorbed fuel vapor into the intake air passage in a non-operational period of the supercharging device, during which the supercharging device does not supercharge the intake air.

4. The purge system according to claim 3, wherein the canister further includes:

a first connection port that penetrates through a wall of the housing and is communicated with the first connection passage;

a second connection port that penetrates through the wall of the housing and is communicated with the second connection passage; and a fuel vapor port that penetrates through the wall of the housing between the first connection port and the second connection port and is communicated with the fuel vapor passage;

a first partition plate that extends from the wall of the housing at a location between the fuel vapor port and the first connection port into the adsorbent in the interior of the housing; and a second partition plate that extends from the wall of the housing at a location between the fuel vapor port and the second connection port into the adsorbent in the interior of the housing and has a length, which is measured in a direction of extension of the second partition plate into the adsorbent and is shorter than that of the first partition plate.

5. The purge system according to claim 4, wherein:

the wall of the housing is a first wall of the housing; and the canister further includes an atmospheric port that is communicated with the atmospheric passage and penetrates through a second wall of the housing, which is opposed to the first wall of the housing.

6. The purge system according to claim 4, wherein:

the wall of the housing is a first wall of the housing;

the canister further includes:

an atmospheric port that is communicated with the atmospheric passage and penetrates through the first wall of the housing;

an interior space that is formed between the adsorbent and a second wall of the housing, which is spaced from the first wall of the housing; and a third partition plate that extends from the first wall of the housing into the interior space through the adsorbent in the interior of the housing and partitions the atmospheric port from the first connection port, the second connection port and the fuel vapor port to guide the air flow from the atmospheric port to the first connection port in the interior of the housing through divided parts of the adsorbent, which are divided by the third partition plate, and also through the interior space.

7. The purge system according to claim 1, further comprising a throttle valve that is provided in the intake air passage on a downstream side of the supercharging device in the flow direction of the intake air in the intake air passage to adjust a quantity of the intake air, which is supplied to the engine, wherein:

the first connection point of the intake air passage is located on a downstream side of the throttle valve in the flow direction of the intake air in the intake air passage; and the control means opens the first valve and the second valve to generate an air flow, which flows from the second connection point of the intake air passage into the first connection point of the intake air passage through the second connection passage, the interior of the housing of the canister and the first connection passage to desorb the fuel vapor from the adsorbent and to purge the desorbed fuel vapor into the intake air passage in a non-operational period of the supercharging device, during which the supercharging device does not supercharge the intake air.

8. The purge system according to claim 7, wherein the canister further includes:

a first connection port that penetrates through a first wall of the housing and is communicated with the first connection passage; and a fuel vapor port that penetrates through the first wall of the housing and is communicated with the fuel vapor passage;

a second connection port that is communicated with the second connection passage and penetrates through a second wall of the housing, which is opposed to the first wall of the housing; and a partition plate that extends from the first wall of the housing at a location between the fuel vapor port and the first connection port into the adsorbent in the interior of the housing.

9. The purge system according to claim 7, wherein the canister further includes:

a first connection port that penetrates through a first wall of the housing and is communicated with the first connection passage;

a second connection port that penetrates through the first wall of the housing and is communicated with the second connection passage; and a fuel vapor port that penetrates through the first wall of the housing between the first connection port and the second connection port and is communicated with the fuel vapor passage;

a first partition plate that extends from the first wall of the housing at a location between the fuel vapor port and the first connection port into the adsorbent in the interior of the housing;

a second partition plate that extends from the first wall at a location between the fuel vapor port and the second connection port through the adsorbent in the interior of the housing; and an interior space that is formed on a distal end side of the second partition plate in the interior of the housing between the adsorbent and a second wall of the housing, which is spaced from the first wall of the housing, wherein the air flow, which flows between the first connection port and the second connection port, is guided by the second partition plate in the interior of the housing through divided parts of the adsorbent, which is divided by the second partition plate, and also through the interior space.

* * * * *